US012790704B2

(12) United States Patent
Kim et al.

(10) Patent No.: US 12,790,704 B2
(45) Date of Patent: Nov. 10, 2026

(54) WATER ELECTROLYSIS DEVICE COMPRISING ELECTROLYTE CORRECTION UNIT HAVING DIAPHRAGM

(71) Applicant: TECHWIN CO., LTD., Chungcheongbuk-do (KR)

(72) Inventors: Jung Sik Kim, Sejong (KR); Hyun Su Shin, Daejeon (KR); Jun Teak Hyun, Chungcheongbuk-do (KR); Sun Teak Hyun, Chungcheongbuk-do (KR)

(73) Assignee: TECHWIN CO., LTD., Chungcheongbuk-Do (KR)

( * ) Notice: Subject to any disclaimer, the term of this patent is extended or adjusted under 35 U.S.C. 154(b) by 560 days.

(21) Appl. No.: 18/275,095

(22) PCT Filed: Jan. 21, 2022

(86) PCT No.: PCT/KR2022/001103
§ 371 (c)(1),
(2) Date: Jul. 31, 2023

(87) PCT Pub. No.: WO2022/164132
PCT Pub. Date: Aug. 4, 2022

(65) Prior Publication Data

US 2024/0117504 A1 Apr. 11, 2024

(30) Foreign Application Priority Data

Feb. 1, 2021 (KR) ..... 10-2021-0014169

(51) Int. Cl.
*C25B 1/04* (2021.01)
*C25B 9/21* (2021.01)
(Continued)

(52) U.S. Cl.
CPC ..... *C25B 15/087* (2021.01); *C25B 1/04* (2013.01); *C25B 9/21* (2021.01); *C25B 13/02* (2013.01); *C25B 15/08* (2013.01)

(58) Field of Classification Search
None
See application file for complete search history.

(56) References Cited

U.S. PATENT DOCUMENTS 4,294,683 A * 10/1981 Pere ..... C25B 15/08 204/266
7,048,839 B2 * 5/2006 Harada ..... C25B 9/05 204/266

(Continued)

FOREIGN PATENT DOCUMENTS

CA 3134812 A1 10/2020
CN 107923054 A 4/2018

(Continued)

OTHER PUBLICATIONS

International Search Report and Written Opinion issued May 4, 2022 in PCT/KR2022/001103.

(Continued)

*Primary Examiner* — Harry D Wilkins, III
(74) *Attorney, Agent, or Firm* — Panitch Schwarze Belisario & Nadel LLP

(57) ABSTRACT

A water electrolysis device includes an electrolyte correction unit having a diaphragm, the device having an electrolyte correction unit, including a diaphragm, for removing a concentration difference inside an electrolyte, so as to prevent a gas composition in a gas phase area of the water electrolysis device from reaching an explosion limit and, simultaneously, prevent the occurrence of a difference in a liquid level due to a difference in the concentration of the electrolyte even if the electrolyte discharged from an anode chamber and the electrolyte discharged from a cathode (Continued)

chamber are each circulated independently, and thus does not require an additional device for solving same, and can resolve the problem of a reduction in processability according to electrolyte re-injection and operation stabilization.

12 Claims, 7 Drawing Sheets

(51) Int. Cl.
*C25B 13/02* (2006.01)
*C25B 15/08* (2006.01)

(56) References Cited

U.S. PATENT DOCUMENTS

| | | | | |
|---|---|---|---|---|
| 10,590,552 | B2 * | 3/2020 | Harano | C25B 15/02 |
| 11,220,755 | B2 * | 1/2022 | Tanaka | C25B 15/083 |
| 2003/0150736 | A1 * | 8/2003 | Kovarsky | B01D 61/52 205/291 |
| 2006/0239872 | A1 * | 10/2006 | Bunn | C25B 1/30 422/186.04 |
| 2016/0368789 | A1 * | 12/2016 | Manabe | C01B 13/0207 |
| 2018/0195183 | A1 * | 7/2018 | Domon | C25B 1/04 |
| 2021/0172074 | A1 * | 6/2021 | Hahn | C25B 15/083 |
| 2021/0262101 | A1 * | 8/2021 | Tanaka | C25B 9/23 |
| 2022/0154356 | A1 * | 5/2022 | Manabe | B01D 19/0031 |

FOREIGN PATENT DOCUMENTS

| | | | |
|---|---|---|---|
| EP | 3312304 | A1 | 4/2018 |
| JP | 2012067336 | A | 4/2012 |
| JP | 2012-111981 | A | 6/2012 |
| JP | 2019-178356 | A | 10/2019 |
| KR | 10-2003-0077910 | A | 10/2003 |
| WO | 2020196835 | A1 | 10/2020 |

OTHER PUBLICATIONS

Extended European Search Report issued Jul. 8, 2025 in EP Application No. 22746159.7.
Office Action and Search Report issued May 20, 2026 in CN Application No. 202280012659.1.

* cited by examiner

[FIG. 1]
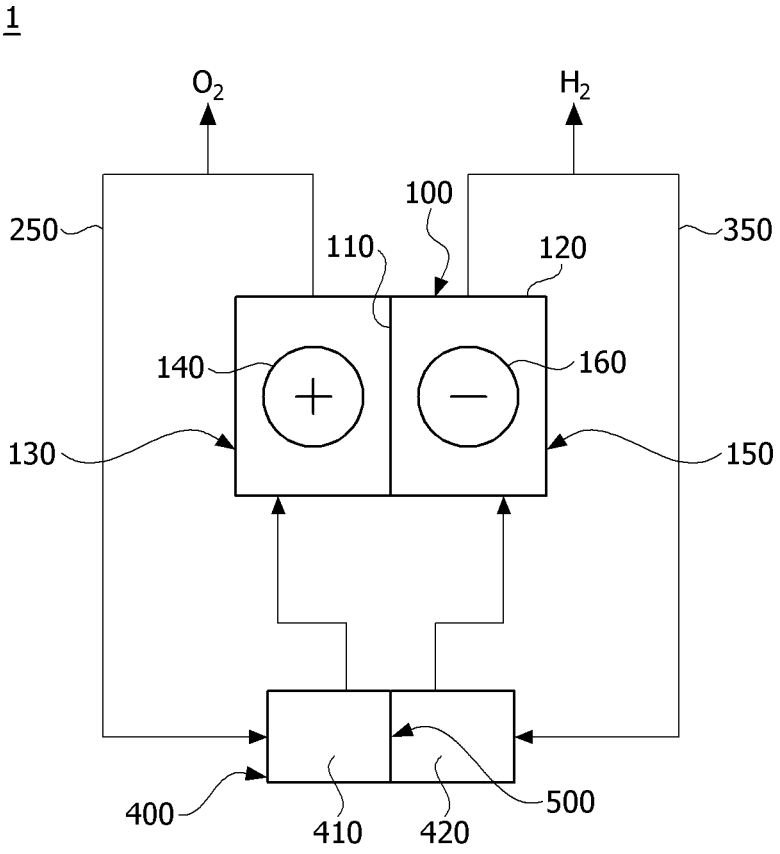

[FIG. 2]
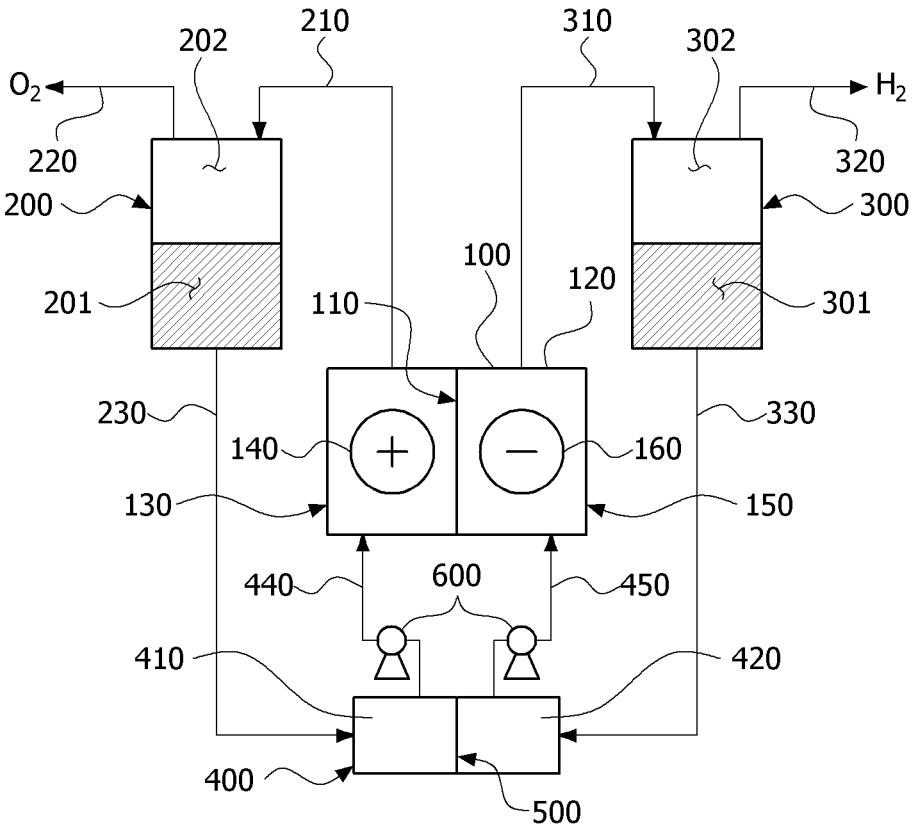

[FIG. 3]
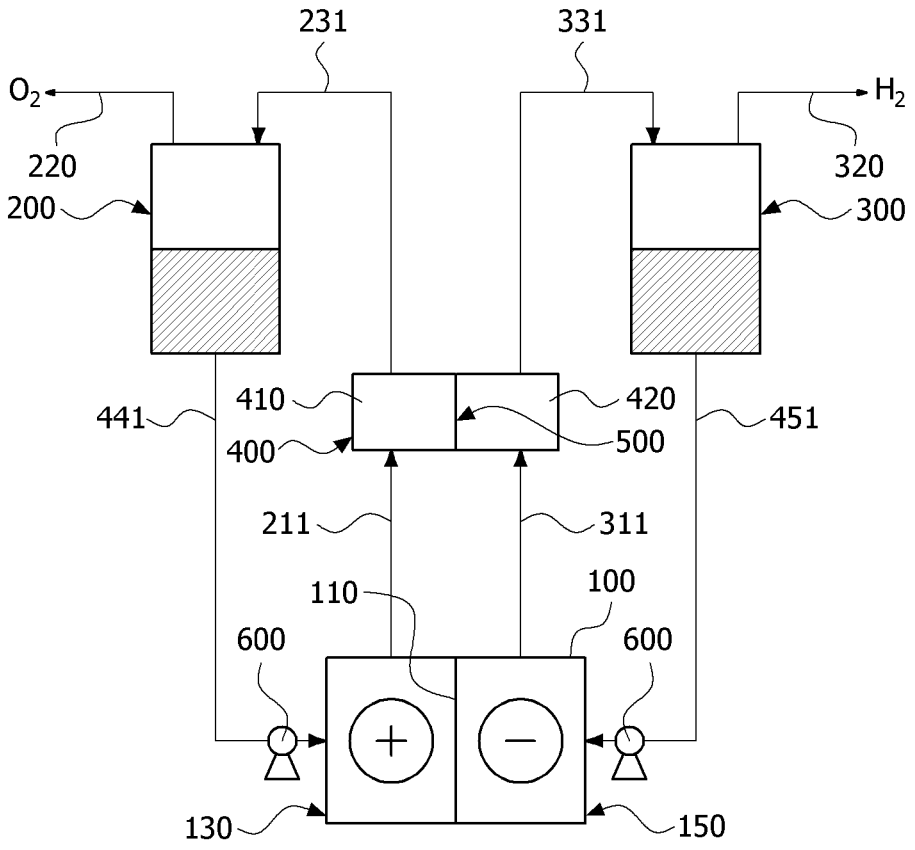

[FIG. 4]
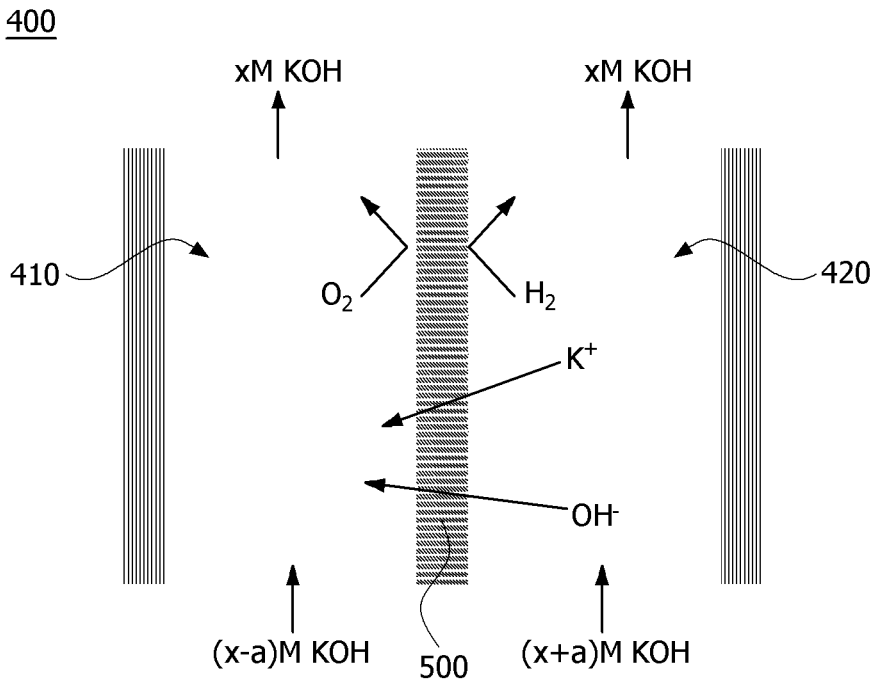
[FIG. 5]
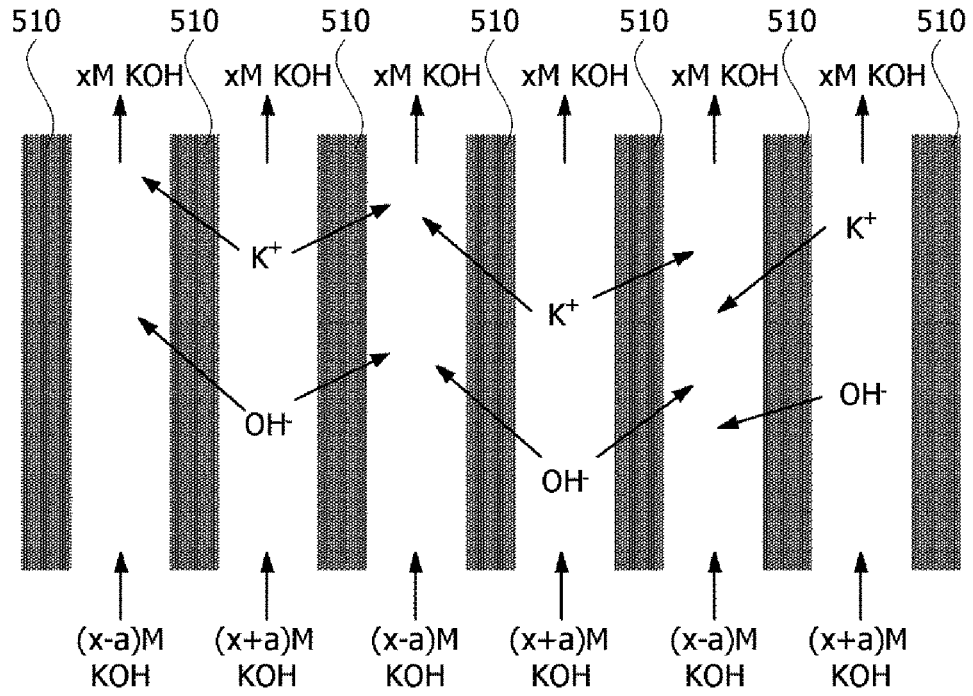

[FIG. 6]
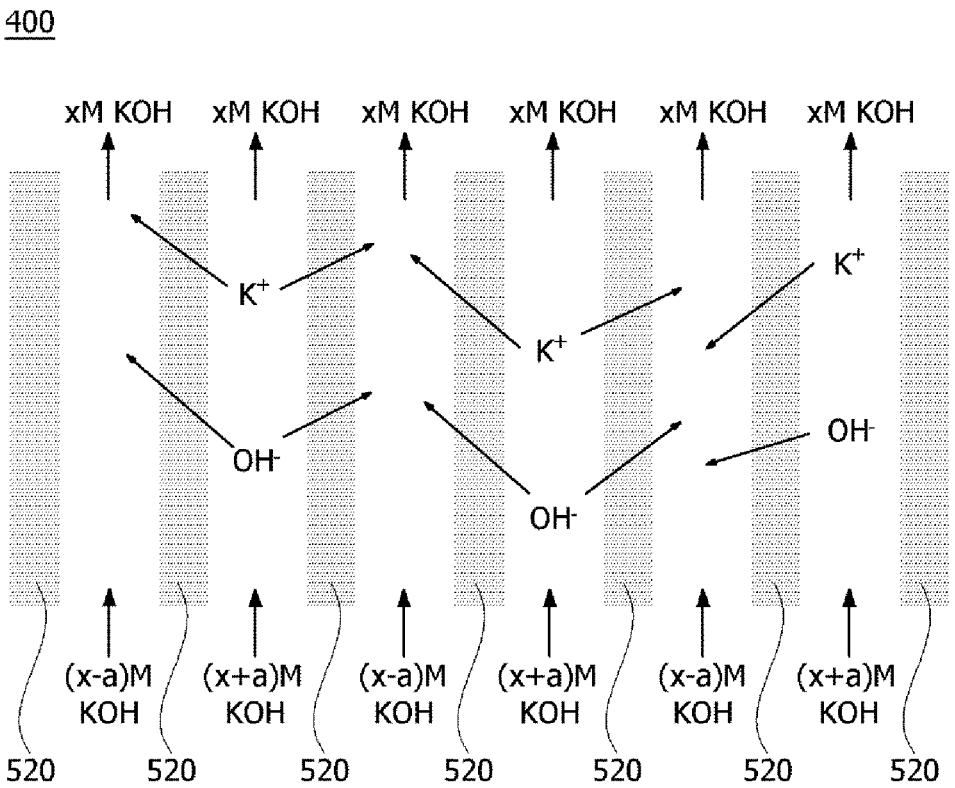

[FIG. 7]
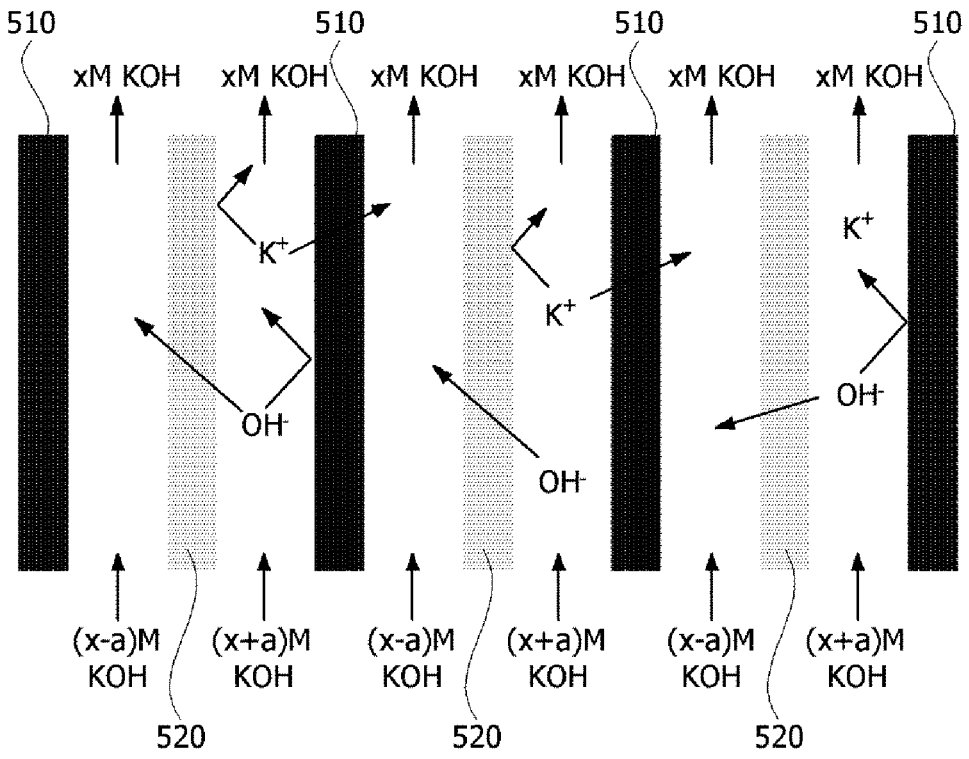

[FIG. 8]
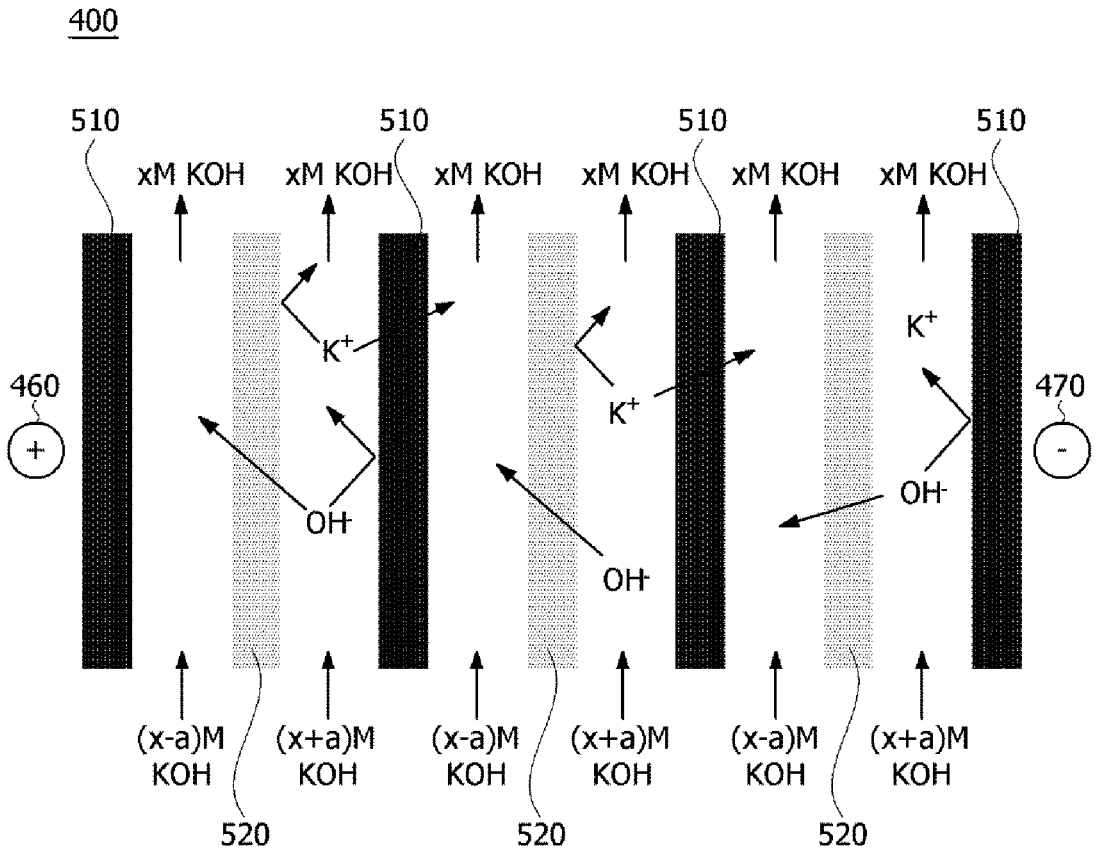

WATER ELECTROLYSIS DEVICE COMPRISING ELECTROLYTE CORRECTION UNIT HAVING DIAPHRAGM

CROSS-REFERENCE TO RELATED APPLICATIONS

This application is a Section 371 of International Application No PCT/KR2022/001103, filed Jan. 21, 2022, which was published in the Korean language on Aug. 4, 2022, under International Publication No. WO 2022/164132 A1, which claims priority under 35 U.S.C. § 119(b) to Korean Application No. 10-2021-0014169 filed Feb. 1, 2021, the disclosures of each of which are incorporated herein by reference.

TECHNICAL FIELD

The present invention relates to a water electrolysis device including an electrolyte correction unit having a diaphragm.

BACKGROUND ART

A water electrolysis technology, which is a representative hydrogen production technology, is a technology of directly producing hydrogen from water using electric energy, and enables high-purity hydrogen to be produced in an eco-friendly manner. The water electrolysis technology is classified into alkaline water electrolysis, polymer electrolyte water electrolysis, and solid oxide water electrolysis.

Among the water electrolysis technologies, the alkaline water electrolysis technology has an advantage of being inexpensive and capable of producing hydrogen in large quantities. The alkaline water electrolysis device includes an electrolytic cell for producing hydrogen, a gas-liquid separator for separating gas-phase hydrogen or oxygen discharged from the electrolytic cell from an electrolyte, an electrolyte reservoir for storing a liquid phase electrolyte discharged from the gas-liquid separator and feeding the liquid phase electrolyte back into the electrolytic cell, and a balance of plant for properly supplying an electrolyte and controlling and managing power.

In addition, the electrolytic cell includes an electrolyte, a separator, and electrodes such as a positive electrode (anode) and a negative electrode (cathode), and the following reactions occur at the positive electrode and the negative electrode.

Positive electrode: $2OH^- \rightarrow \frac{1}{2}O_2 + H_2O + 2e^-$

Negative electrode: $2H_2O + 2e^- \rightarrow H_2 + 2OH^-$

In a positive electrode chamber of the electrolytic cell, the electrolyte containing dissolved oxygen gas produced by the reaction is separated into oxygen gas and an electrolyte through the gas-liquid separator at the positive electrode, and in a negative electrode chamber of the electrolytic cell, the electrolyte containing dissolved hydrogen gas produced by the reaction is separated into hydrogen gas and an electrolyte through the gas-liquid separator at the negative electrode.

In this case, there is a problem of a dissolved gas in the production of hydrogen using alkaline water electrolysis. That is, some of the oxygen gas generated from the reaction at the positive electrode is dissolved in the electrolyte recovered from the positive electrode chamber of the electrolytic cell, and some of the hydrogen gas generated from the reaction at the negative electrode is dissolved in the electrolyte recovered from the negative electrode chamber. Here, the concept of the oxygen gas and hydrogen gas being dissolved in the electrolyte includes a state in which the oxygen gas and the hydrogen gas are dissolved in the electrolyte and a state in which the oxygen gas and the hydrogen gas remain in the form of microbubbles. Since the electrolyte recovered from the positive electrode chamber and the electrolyte recovered from the negative electrode chamber are mixed in the electrolyte reservoir, both the oxygen gas and the hydrogen gas are dissolved in the electrolyte in the electrolyte reservoir. The oxygen gas and the hydrogen gas dissolved in the electrolyte in the electrolyte reservoir are gradually released into a gas phase, concentrations of the oxygen gas and the hydrogen gas gradually rise in a gas phase region of an upper portion of the electrolyte reservoir. Therefore, while an operation of the water electrolysis device continues, there is a concern that a gas composition in the gas phase region of the upper portion of the electrolyte reservoir may reach an explosion limit.

Japanese Patent Laid-Open Application No. 2017-039982 (hereinafter referred to as "Patent Document 1") for a water electrolysis device for generating hydrogen gas discloses a water electrolysis device which includes a positive electrode chamber for accommodating a positive electrode and generating a positive electrode gas, a negative electrode chamber for accommodating a negative electrode and generating hydrogen gas, a diaphragm for partitioning the positive electrode chamber from the negative electrode chamber, and a positive electrode circulation line which discharges an electrolyte from the positive electrode chamber and simultaneously returns the electrolyte to the positive electrode chamber. The water electrolysis device includes the positive electrode circulation line for connecting a positive electrode gas-liquid separator, which separates the positive electrode gas from the electrolyte, to the positive electrode chamber, a positive electrode side discharge line which discharges the electrolyte and the positive electrode gas from the positive electrode chamber and supplies the electrolyte and the positive electrode gas to the positive electrode gas-liquid separator, a positive electrode supply line which connects the positive electrode chamber to the gas-liquid separator at the positive electrode, discharges the electrolyte from the gas-liquid separator at the positive electrode, and supplies the electrolyte to the positive electrode chamber, a gas-phase area in which the dissolved hydrogen gas is present in a gas phase and the hydrogen gas and the positive electrode gas are mixed, and a positive electrode gas delivery line connecting the gas-liquid separator on the positive electrode side, wherein the positive electrode gas delivery line supplies at least a portion of the positive electrode gas to the gas-phase area, and a hydrogen gas concentration in the gas-phase area is less than a lower explosion limit. It is disclosed that the water electrolysis device having the form of Patent Document 1 can eliminate a probability of a small amount of hydrogen gas gradually accumulating in a circulation line of the electrolyte and reaching an explosion limit of hydrogen.

However, Patent Document 1 discloses that a gas discharged from the gas-phase area of the electrolyte reservoir is discharged to the outside of the system, and when the gas in the gas-phase area of the electrolyte reservoir is purged using the positive electrode gas and then discharged, it is difficult to obtain high-purity gas even when the discharged gas is recovered.

Meanwhile, when the electrolyte recovered from the positive electrode chamber and the electrolyte recovered from the negative electrode chamber are stored in different electrolyte reservoirs and then circulated, due to a difference in the number of moles consumed in the positive electrode reaction and the negative electrode reaction, there is a problem in that a difference in concentration between the electrolyte present in the electrolyte reservoir at the positive electrode and the electrolyte present in the electrolyte reservoir at the negative electrode occurs.

In order to prevent the occurrence of the difference in concentration between the electrolyte present in the electrolyte reservoir at the positive electrode and the electrolyte present in the electrolyte reservoir at the negative electrode, when a communication pipe is additionally installed between a liquid-phase area of the electrolyte reservoir at the positive electrode and a liquid-phase area of the electrolyte reservoir at the negative electrode, since the electrolyte introduced through the communication pipe contains a dissolved gas, there is a probability that a gas composition in the gas-phase area may reach an explosion limit in the reservoir in which the electrolyte is introduced through the communication pipe.

Therefore, there is a need for a water electrolysis device which prevents a gas composition in a gas-phase area of an electrolyte reservoir from reaching an explosion limit and simultaneously prevents a concentration difference between electrolytes even when an electrolyte discharged from a positive electrode chamber and an electrolyte discharged from a negative electrode chamber are independently circulated.

DISCLOSURE

Technical Problem

The present invention is directed to providing a water electrolysis device which prevents a gas composition in a gas-phase area of an electrolyte reservoir from reaching an explosion limit and simultaneously prevents a concentration difference between electrolytes even when an electrolyte discharged from a positive electrode chamber and an electrolyte discharged from a negative electrode chamber are independently circulated.

Technical Solution

One aspect of the present invention provides a water electrolysis device including an electrolytic cell including a positive electrode chamber and a negative electrode chamber, which are partitioned by a partition wall; an electrolyte correction unit including a positive electrode chamber electrolyte reservoir and a negative electrode chamber electrolyte reservoir, wherein the positive electrode chamber electrolyte reservoir and the negative electrode chamber electrolyte reservoir are divided by a diaphragm; a positive electrode circulation line configured to communicate the positive electrode chamber of the electrolytic cell with the positive electrode chamber electrolyte reservoir of the electrolyte correction unit; and a negative electrode circulation line configured to communicate the negative electrode chamber of the electrolytic cell with the negative electrode chamber electrolyte reservoir of the electrolyte correction unit.

The water electrolysis device may further include a gas-liquid separator at a positive electrode provided at the positive electrode circulation line, and a gas-liquid separator at a negative electrode provided at the negative electrode circulation line.

The gas-liquid separator at the positive electrode may be provided at a rear end of the positive electrode chamber of the electrolytic cell and at a front end of the positive electrode chamber electrolyte reservoir of the electrolyte correction unit along the positive electrode circulation line, and the gas-liquid separator at the negative electrode may be provided at a rear end of the negative electrode chamber of the electrolytic cell and at a front end of the negative electrode chamber electrolyte reservoir of the electrolyte correction unit along the negative electrode circulation line.

The gas-liquid separator at the positive electrode may be provided at a rear end of the positive electrode chamber electrolyte reservoir of the electrolyte correction unit and at a front end of the positive electrode chamber of the electrolytic cell along the positive electrode circulation line, and the gas-liquid separator at the negative electrode may be provided at a rear end of the negative electrode chamber electrolyte reservoir of the electrolyte correction unit and at a front end of the negative electrode chamber of the electrolytic cell along the negative electrode circulation line.

The diaphragm may be permeable to an electrolyte and an ion and may be impermeable to a gas.

The diaphragm may be a porous membrane.

The diaphragm may be a cation exchange membrane or an anion exchange membrane.

The diaphragm may be provided as a plurality of diaphragms, and the positive electrode chamber electrolyte reservoir and the negative electrode chamber electrolyte reservoir may be alternately disposed.

When the positive electrode chamber electrolyte reservoir and the negative electrode chamber electrolyte reservoir are alternately disposed, the plurality of diaphragms alternately disposed in a direction in which the reservoirs are alternately disposed may include cation exchange membranes and anion exchange membranes, which are alternately provided.

A positive electrode and a negative electrode may be provided at both ends of the electrolyte correction unit, and thus the diaphragm may be positioned between the positive electrode and the negative electrode.

The diaphragm may be a cation exchange membrane or an anion exchange membrane, the cation exchange membrane may be positioned on a side surface adjacent to the positive electrode of the positive electrode chamber electrolyte reservoir, the anion exchange membrane may be positioned on a side surface adjacent to the negative electrode of the positive electrode chamber electrolyte reservoir, the anion exchange membrane may be positioned on a side surface adjacent to the positive electrode of the negative electrode chamber electrolyte reservoir, and the cation exchange membrane may be positioned on a side surface adjacent to the negative electrode of the negative electrode chamber electrolyte reservoir.

A water supply pipe and a water supply pump, which are configured to supply water, may be further provided in at least one among the negative electrode chamber of the electrolytic cell, the negative electrode circulation line and the negative electrode chamber electrolyte reservoir of the electrolyte correction unit.

A water supply pipe and a water supply pump for supplying water may be further provided at the gas-liquid separator at the negative electrode.

Advantageous Effects

In accordance with a water electrolysis device according to the present invention, by including an electrolyte correction unit with a diaphragm for eliminating a difference in concentration between electrolytes, a gas composition in a gas-phase area of an electrolyte reservoir is prevented from reaching an explosion limit, and simultaneously, a concentration difference between electrolytes is prevented even when an electrolyte discharged from a positive electrode chamber and an electrolyte discharged from a negative electrode chamber are independently circulated. Thus, there is an effect of not requiring an additional device for solving the problem of reaching the explosion limit and the concentration difference and preventing deterioration in processability due to electrolyte re-injection and operation stabilization.

DESCRIPTION OF DRAWINGS

FIG. 1 is a block diagram illustrating an electrolytic cell, an electrolyte correction unit, a positive electrode circulation line, and a negative electrode circulation line of a water electrolysis device of the present invention.

FIG. 2 is a block diagram illustrating a water electrolysis device according to one embodiment of the present invention.

FIG. 3 is a block diagram illustrating a water electrolysis device according to another embodiment of the present invention.

FIG. 4 is a schematic diagram illustrating a shape of a diaphragm inside the electrolyte correction unit of the present invention.

FIG. 5 is a schematic diagram illustrating a form in which a plurality of cation exchange membranes are provided inside the electrolyte correction unit of the present invention.

FIG. 6 is a schematic diagram illustrating a form in which a plurality of anion exchange membranes are provided inside the electrolyte correction unit of the present invention.

FIG. 7 is a schematic diagram illustrating a form in which a plurality of cation exchange membranes and a plurality of anion exchange membranes are provided inside the electrolyte correction unit of the present invention.

FIG. 8 is a schematic diagram illustrating a form in which electrodes are formed in the electrolyte correction unit of the present invention.

MODES OF THE INVENTION

The present invention may be modified into various forms and may have a variety of example embodiments, and therefore, specific embodiments will be illustrated in the drawings and described in detail.

The embodiments, however, are not to be taken in a sense which limits the present invention to the specific embodiments and should be construed to include modifications, equivalents, or substituents within the spirit and technical scope of the present invention.

In the present invention, it should be understood that the terms "comprise," "include," and "have" specify the presence of stated features, numbers, steps, operations, components, elements, or combinations thereof but do not preclude the presence or possibility of adding one or more other features, numbers, steps, operations, components, elements, or combinations thereof.

Therefore, the embodiments described herein and the configurations shown in the drawings are merely the most exemplary embodiments of the present invention and do not represent all the technical spirit of the present invention, and it should be understood that there may be various equivalents and modifications capable of substituting for the embodiments and the configurations at the time of filing of the present application.

Referring to FIG. 1, according to the present invention, a water electrolysis device 1 includes an electrolytic cell 100 including a positive electrode chamber 130 and a negative electrode chamber 150 which are partitioned by a partition wall 110, an electrolyte correction unit 400 including a positive electrode chamber electrolyte reservoir 410 and a negative electrode chamber electrolyte reservoir 420, wherein the positive electrode chamber electrolyte reservoir 410 and the negative electrode chamber electrolyte reservoir 420 are divided by a diaphragm 500, a positive electrode circulation line 250 which communicates the positive electrode chamber 130 of the electrolytic cell with the positive electrode chamber electrolyte reservoir 410 of the electrolyte correction unit, and a negative electrode circulation line 350 which communicates the negative electrode chamber 150 of the electrolytic cell with the negative electrode chamber electrolyte reservoir 420 of the electrolyte correction unit 400.

The water electrolysis device 1 is a device for producing oxygen gas and hydrogen gas by electrolysis using an electrolyte.

The electrolytic cell 100 includes the positive electrode chamber 130 including a positive electrode 140 and generating oxygen gas, and the negative electrode chamber 150 including a negative electrode 160 and generating hydrogen gas. The positive electrode chamber 130 and the negative electrode chamber 150 are partitioned by the partition wall 110.

The partition wall 110 partitions the positive electrode chamber 130 from the negative electrode chamber 150 and has gas blockability, and a shape or material of the partition wall 110 is not particularly limited.

The partition wall 110 may have a plate shape with a predetermined thickness, and the partition wall 110 may have high electrolyte permeability, high ion permeability, and high gas blockability. A material of the partition wall may include polymer resin fibers and inorganic compounds, and for example, a porous polymer film may be used.

The positive electrode chamber 130 and the negative electrode chamber 150 are each provided with a space surrounded by the partition wall 110 and an outer frame 120, and an electrolyte introduced from the electrolyte correction unit 400 passes through the space.

In this case, the following reactions occur at the positive electrode of the positive electrode chamber and the negative electrode of the negative electrode chamber.

$$\text{Positive electrode: } 2OH^- \rightarrow \tfrac{1}{2}O_2 + H_2O + 2e^-$$

$$\text{Negative electrode: } 2H_2O + 2e^- \rightarrow H_2 + 2OH^-$$

That is, hydroxide ions ($OH^-$) are consumed and oxygen gas is generated in the positive electrode chamber, and hydroxide ions ($OH^-$) and hydrogen gas are generated in the negative electrode chamber.

In this case, there is a problem of a dissolved gas in the production of hydrogen using alkaline water electrolysis. That is, some of the oxygen gas generated from the reaction at the positive electrode reaction is dissolved in the electrolyte discharged from the positive electrode chamber of the electrolytic cell, and some of the hydrogen gas generated from the reaction at the negative electrode is dissolved in the electrolyte discharged from the negative electrode chamber.

In the present invention, the concept of the oxygen gas and hydrogen gas being dissolved in the electrolyte includes a state in which the oxygen gas and the hydrogen gas are dissolved in the electrolyte and a state in which the oxygen gas and the hydrogen gas remain in the form of microbubbles.

Therefore, while an operation of the water electrolysis device continues, when concentrations of the oxygen gas and the hydrogen gas dissolved in the electrolyte during the circulation flow of the electrolyte exceed a predetermined range (explosion range), there is a concern that the water electrolysis device may explode.

A technical feature of the present invention is that, in order to adjust the concentrations of the oxygen gas and the hydrogen gas dissolved in the electrolyte to be less than or equal to an explosion limit, the electrolyte correction unit 400 is provided at a front or rear end of the electrolytic cell 100.

The present invention may further include a gas-liquid separator 200 at the positive electrode provided in the positive electrode circulation line 250 and a gas-liquid separator 300 at the negative electrode provided in the negative electrode circulation line 350.

In this case, as one example, the gas-liquid separator 200 on the positive electrode is provided between the positive electrode chamber 130 at the electrolytic cell and the positive electrode chamber electrolyte reservoir 410 at the electrolyte correction unit along the positive electrode circulation line 250, and specifically, is provided at a rear end of the positive electrode chamber 130 of the electrolytic cell and at a front end of the positive electrode chamber electrolyte reservoir 410 of the electrolyte correction unit along the positive electrode circulation line 250. In addition, the gas-liquid separator 300 at the negative electrode may be provided between the negative electrode chamber 150 at the electrolytic cell and the negative electrode chamber electrolyte reservoir 420 at the electrolyte correction unit along the negative electrode circulation line 350. Specifically, the gas-liquid separator 300 at the negative electrode side may be provided at a rear end of the negative electrode chamber 150 of the electrolytic cell and at a front end of the negative electrode chamber electrolyte reservoir 420 of the electrolyte correction unit along the negative electrode circulation line 350.

Referring to FIG. 2, in the present embodiment, the positive electrode circulation line 250 may be divided into a positive electrode recovery pipe 210 communicating the positive electrode chamber 130 with the gas-liquid separator 200 at the positive electrode, a positive electrode electrolyte recovery pipe 230 communicating the gas-liquid separator 200 at the positive electrode with the positive electrode chamber electrolyte reservoir 410, and a positive electrode electrolyte supply pipe 440 communicating the positive electrode chamber electrolyte reservoir 410 with the positive electrode chamber 130.

In addition, the gas-liquid separator 200 at the positive electrode includes a liquid-phase area 201 positioned at a lower portion and a gas-phase area 202 positioned above the liquid-phase area, and the gas-liquid separator 300 at the negative electrode includes a liquid-phase area 301 positioned at a lower portion and a gas-phase area 302 positioned above the liquid-phase area.

In addition, the negative electrode circulation line 350 may be divided into a negative electrode recovery pipe 310 communicating the negative electrode chamber 150 with the gas-liquid separator 300 at the negative electrode, a negative electrode electrolyte recovery pipe 330 communicating the gas-liquid separator 300 at the negative electrode with the negative electrode chamber electrolyte reservoir 420, and a negative electrode electrolyte supply pipe 450 communicating the negative electrode chamber electrolyte reservoir 420 with the negative electrode chamber 150.

Specifically, the gas-liquid separator 200 at the positive electrode communicates with the positive electrode chamber 130 through the positive electrode recovery pipe 210 and separates an electrolyte from oxygen gas, which are discharged from the positive electrode chamber 130. The gas-liquid separator 300 at the negative electrode communicates with the negative electrode chamber 150 through the negative electrode recovery pipe 310 and separates an electrolyte from hydrogen gas, which are discharged from the negative electrode chamber 150.

In this case, the positive electrode recovery pipe 210 and the negative electrode recovery pipe 310 may communicate with the upper portions of the gas-liquid separator 200 at the positive electrode and the gas-liquid separator 300 at the negative electrode.

When the positive electrode recovery pipe 210 and the negative electrode recovery pipe 310 communicate with the upper portions of the gas-liquid separator 200 at the positive electrode and the gas-liquid separator 300 at the negative electrode, a time for the electrolyte, which contains the dissolved gas discharged from the electrolytic cell, to fall to a liquid level inside the gas-liquid separator increases, and thus gas-liquid separation efficiency can be increased.

The electrolyte correction unit 400 communicates with the gas-liquid separator 200 at the positive electrode through the positive electrode electrolyte recovery pipe 230 and communicates with the gas-liquid separator 300 at the negative electrode through the negative electrode electrolyte recovery pipe 330, and the diaphragm 500 is provided inside the electrolyte correction unit 400.

Specifically, the electrolyte correction unit 400 includes the positive electrode chamber electrolyte reservoir 410 communicating with the gas-liquid separator 200 at the positive electrode through the positive electrode electrolyte recovery pipe 230, and the negative electrode chamber electrolyte reservoir 420 communicating the gas-liquid separator 300 at the negative electrode through the negative electrode electrolyte recovery pipe 330, and the positive electrode chamber electrolyte reservoir 410 and the negative electrode chamber electrolyte reservoir 420 are separated by the diaphragm 500.

In this case, the positive electrode electrolyte recovery pipe 230 communicates with the liquid-phase area 201 of the gas-liquid separator 200 at the positive electrode, and the negative electrode electrolyte recovery pipe 330 communicates with the liquid-phase area 301 of the gas-liquid separator 300 at the negative electrode.

The electrolyte correction unit 400 accommodates the electrolytes present in the liquid-phase areas 201 and 301 of the gas-liquid separator 200 at the positive electrode and the gas-liquid separator 300 at the negative electrode and supplies the electrolytes to the positive electrode chamber 130 and negative electrode chamber 150 of the electrolytic cell 100 through the positive electrode electrolyte supply pipe 440 communicating with the positive electrode chamber electrolyte reservoir 410 and the negative electrode electrolyte supply pipe 450 communicating with the negative electrode chamber electrolyte reservoir 420.

In addition, circulation pumps 600 for supplying the electrolyte of the electrolyte correction unit 400 to the electrolytic cell 100 may be provided at the positive electrode electrolyte supply pipe 440 and the negative electrode electrolyte supply pipe 450. At this time, the circulation pumps 600 may be configured with only one circulation pump after combining the positive electrode electrolyte supply pipe 440 and the negative electrode electrolyte supply pipe 450 into one supply pipe.

The electrolyte introduced from the gas-liquid separator 200 at the positive electrode and the electrolyte introduced from the gas-liquid separator 300 at the negative electrode may be separated in the electrolyte correction unit 400 by the diaphragm 500 provided in the electrolyte correction unit 400.

The diaphragm 500 may have different liquid and gas permeability in order to pass ions and electrolytes and isolate the hydrogen gas and the oxygen gas which are generated in the electrolytic cell.

Specifically, the diaphragm includes pores, and by adjusting sizes of the pores, the liquid and gas permeability may be made different. Alternatively, by adjusting a size of a polymer resin fiber or an inorganic particle, the liquid and gas permeability may be made different.

For example, the sizes of the pores, the polymer resin fiber, or the inorganic particle may range from 0.01 μm to 10 μm.

The diaphragm having the above characteristics may be achieved by adjusting a diameter, a surface area, hydrophilicity, and a formation structure of the pores, and for example, a polymer porous film, an inorganic porous film, a woven fabric, or non-woven fabric may be used as the diaphragm.

The diaphragm may be permeable to an electrolyte and an ion and may be impermeable to a gas.

The gas being impermeable may mean that gas permeability is 10 $l/min \cdot cm^3$ or less when measured at a pressure of 5 bar, and, for example, the diaphragm has gas permeability of 7 $l/min \cdot cm^3$ or less or 5 $l/min \cdot cm^3$ or less when measured at a pressure of 5 bar.

A material of the diaphragm 500 may be at least one selected from the group consisting of polyethylene, polypropylene, polyethylene terephthalate, polysulfone, polyphenylene sulfide, polyether sulfone, polyphenyl sulfone, polyvinylidene fluoride, polyacrylonitrile, polyethylene oxide, polymethyl methacrylate, polyamide, polyether ether ketone, sulfonated polyether ether ketone, polyimide, and a copolymer thereof.

The diaphragm 500 may be a porous film and may have a three-dimensional porous network.

Sizes of pores of the porous film are not particularly limited as long as it is permeable to an electrolyte and an ion and can be controlled to be impermeable to a gas and may range, for example, from 0.01 μm to 10 μm.

Alternatively, the diaphragm 500 may be an ion exchange membrane, and the ion exchange membrane may be an anion exchange membrane or a cation exchange membrane. Examples of the ion exchange membrane may include a fluorine-containing ion exchange membrane. In this case, the ion exchange membrane may be porous or non-porous.

According to the present invention, by providing the above-described diaphragm 500 as in the electrolyte correction unit 400, it is possible to prevent the mixing of the oxygen gas generated at the positive electrode and the hydrogen gas generated at the negative electrode in the electrolyte correction unit. In this way, it is possible to maintain a concentration of the hydrogen gas in the oxygen gas and a concentration of the oxygen gas in the hydrogen gas to be less than or equal to the explosion range.

That is, in the water electrolysis device according to the present invention, the electrolyte circulating through the positive electrode chamber 130 of the electrolytic cell 100, the positive electrode recovery pipe 210, the gas-liquid separator 200 at the positive electrode, the positive electrode electrolyte recovery pipe 230, the positive electrode chamber electrolyte reservoir 410, and the positive electrode electrolyte supply pipe 440, and the electrolyte circulating through the negative electrode chamber 150 of the electrolytic cell 100, the negative electrode recovery pipe 310, the gas-liquid separator 300 at the negative electrode, the negative electrode electrolyte recovery pipe 330, the negative electrode chamber electrolyte reservoir 420, and the negative electrode electrolyte supply pipe 450 independently circulate.

Therefore, in the water electrolysis device according to the present invention, since the oxygen gas and the hydrogen gas of the electrolytes of the positive electrode chamber and the negative electrode chamber, in which the oxygen gas and the hydrogen gas are dissolved, are not mixed, the concentration of the hydrogen gas may be maintained within the explosion range.

In addition, in the positive electrode chamber 130 and negative electrode chamber 150 of the electrolytic cell 100, a concentration gradient is generated between the electrolyte discharged from the positive electrode chamber and the electrolyte discharged from the negative electrode chamber due to the reactions in which hydroxide ions ($OH^-$) are consumed and generated, and thus there is a problem of mixing the hydrogen gas and the oxygen gas in the process of correcting the difference in concentration between the electrolytes. According to the present invention, since the diaphragm 500 is provided inside the electrolyte correction unit and the diaphragm 500 has ion permeability, the difference in concentration between the electrolyte discharged from the positive electrode chamber 130 and the electrolyte discharged from the negative electrode chamber 150 may be corrected. Therefore, it is possible to solve the problem of requiring an additional device due to a difference in liquid level of the electrolytes and the problem of deterioration in processability due to electrolyte re-injection and operation stabilization.

In addition, in the electrolyte correction unit 400, the electrolyte introduced from the gas-liquid separator 200 at the positive electrode and the electrolyte introduced from the gas-liquid separator 300 at the negative electrode may be alternately introduced with a plurality of diaphragms interposed therebetween.

That is, since the electrolyte correction unit 400 is provided with a plurality of diaphragms, the positive electrode chamber electrolyte reservoir 410 and the negative electrode chamber electrolyte reservoir 420 may be formed as a plurality of positive electrode chamber electrolyte reservoirs and a plurality of negative electrode chamber electrolyte reservoirs. In this case, the positive electrode chamber electrolyte reservoirs 410 and the negative electrode chamber electrolyte reservoirs 420 may be alternately disposed.

As described above, when the positive electrode chamber electrolyte reservoirs 410 and the negative electrode chamber electrolyte reservoirs 420 are formed with the plurality of diaphragms interposed therebetween, a relatively low-concentration electrolyte introduced from the gas-liquid separator 200 at the positive electrode and a relatively high-concentration electrolyte introduced from the gas-liquid separator 300 at the negative electrode exchange ions so that the concentration difference may be resolved.

In this case, the plurality of diaphragms may be cation exchange membranes or anion exchange membranes and may be formed only of cation exchange membranes or only anion exchange membranes.

Alternatively, the plurality of diaphragms may be diaphragms in which cation exchange membranes and anion exchange membranes are alternately provided.

In this case, when the positive electrode chamber electrolyte reservoirs 410 and the negative electrode chamber electrolyte reservoirs 420 are alternately disposed, the plurality of diaphragms alternately disposed in a direction in which the reservoirs are alternately disposed may include alternately provided cation exchange membranes and anion exchange membranes.

In addition, a positive electrode and a negative electrode are provided at both ends of the electrolyte correction unit 400, and thus the diaphragm may be positioned between the positive electrode and the negative electrode. When power is applied to the electrodes and thus a difference in electromotive force is generated, an ion exchange rate may be increased to improve productivity.

Specifically, the diaphragm may be a cation exchange membrane or an anion exchange membrane, the cation exchange membrane may be positioned on a side surface adjacent to the positive electrode of the positive electrode chamber electrolyte reservoir, the anion exchange membrane may be positioned on a side surface adjacent to the negative electrode of the positive electrode chamber electrolyte reservoir, the anion exchange membrane may be positioned on a side surface adjacent to the positive electrode of the negative electrode chamber electrolyte reservoir, and the cation exchange membrane may be positioned on a side surface adjacent to the negative electrode of the negative electrode chamber electrolyte reservoir. In addition, a separate electrolyte may be supplied into a space in which the positive electrode and the negative electrode are provided.

The electrolyte used in the present invention may be an alkaline aqueous solution in which an alkali salt is dissolved. For example, the electrolyte may be a NaOH aqueous solution or a KOH aqueous solution.

In this case, a concentration of the alkali salt may range from 1 wt % to 50 wt %. For example, when the electrolyte is a NaOH aqueous solution, a content of NaOH may range from 1 wt % to 20 wt % or from 10 wt % to 15 wt %. In addition, when the electrolyte is a KOH aqueous solution, a content of KOH may range from 20 wt % to 50 wt %, for example, from 25 wt % to 40 wt % or from 25 wt % to 35 wt %.

In addition, a water supply pipe and a water supply pump, which supply water from a water reservoir, may be provided at the negative electrode chamber 150 of the electrolytic cell, the negative electrode chamber electrolyte reservoir 420 of the electrolyte correction unit, the gas-liquid separator 300 at the negative electrode, and the negative electrode circulation line 350.

As another embodiment, the gas-liquid separator 200 at the positive electrode may be provided at the rear end of the positive electrode chamber electrolyte reservoir 410 of the electrolyte correction unit and the front end of the positive electrode chamber 130 of the electrolytic cell along the positive electrode circulation line 250, and the gas-liquid separator 300 at the negative electrode may be provided at the rear end of the negative electrode chamber electrolyte reservoir 420 of the electrolyte correction unit and at the front end of the negative electrode chamber 150 of the electrolytic cell along the negative electrode circulation line 350.

Referring to FIG. 3, in the above embodiment, the positive electrode circulation line 250 may be divided into a second positive electrode recovery pipe 211 communicating the positive electrode chamber 130 with the positive electrode chamber electrolyte reservoir 410, a second positive electrode electrolyte recovery pipe 231 communicating the positive electrode chamber electrolyte reservoir 410 with the gas-liquid separator 200 at the positive electrode, and a second positive electrode positive electrode electrolyte supply pipe 441 communicating the gas-liquid separator 200 at the positive electrode with the positive electrode chamber 130.

In addition, the negative electrode circulation line 350 may be divided into a second negative electrode recovery pipe 311 communicating the negative electrode chamber 150 with the negative electrode chamber electrolyte reservoir 420, a second negative electrode electrolyte recovery pipe 331 communicating the negative electrode chamber electrolyte reservoir 420 with the gas-liquid separator 300 at the negative electrode, and a second negative electrode electrolyte supply pipe 451 communicating the gas-liquid separator 300 at the negative electrode with the negative electrode chamber 150.

The positive electrode chamber electrolyte reservoir 410 communicates with the positive electrode chamber 130 through the second positive electrode recovery pipe 211 and accommodates an electrolyte and oxygen gas, which are discharged from the positive electrode chamber 130. The negative electrode chamber electrolyte reservoir 420 communicates with the negative electrode chamber 150 through the second negative electrode recovery pipe 311 and accommodates an electrolyte and hydrogen gas, which are discharged from the negative electrode chamber 150.

In the electrolyte correction unit 400, ions of the electrolyte in the positive electrode chamber electrolyte reservoir 410 and ions of the electrolyte in the negative electrode chamber electrolyte reservoir 420 are exchanged through the diaphragm 500.

Through the ion exchange, a difference in concentration between the electrolyte in the positive electrode chamber electrolyte reservoir 410 and the electrolyte in the negative electrode chamber electrolyte reservoir 420 is resolved.

The positive electrode chamber electrolyte reservoir 410 communicates with the gas-liquid separator 200 at the positive electrode through the second positive electrode electrolyte recovery pipe 231, and the negative electrode chamber electrolyte reservoir 420 communicates with the gas-liquid separator 300 at the negative electrode through the second negative electrode electrolyte recovery pipe 331.

The electrolytes present in the liquid-phase areas of the gas-liquid separator 200 at the positive electrode and the gas-liquid separator 300 at the negative electrode are supplied to the positive electrode chamber 130 and the negative electrode chamber 150 of the electrolytic cell 100 through the second positive electrode electrolyte supply pipe 441 and the second negative electrode electrolyte supply pipe 451.

The embodiment according to FIG. 2 and the embodiment according to FIG. 3 differ only according to whether the positions of the gas-liquid separator 200 at the positive electrode and the gas-liquid separator 300 at the negative electrode are at the front or rear end of the electrolytic cell, the main role and structure of the electrolyte correction unit 400 are the same, and the above-described main content can be equally applied.

KOH may be used as the electrolyte according to the present invention, and a concentration of the electrolyte may range from 20% to 50%, but the present invention is not limited thereto.

In addition, operating conditions are not particularly limited, but, for example, a temperature of the electrolyte may range from 30° C. to 200° C., a current density of the electrolytic cell may range from 1 $kA/m^2$ to 50 $kA/m^2$, and a pressure of the electrolytic cell may range from 0.1 Mpa to 20 Mpa.

Hereinafter, specific examples of the present invention will be presented. However, the embodiments described below are only intended to specifically illustrate or describe the present invention, and the present invention should not be limited thereto.

Example 1-1

Referring to FIG. 2, the water electrolysis device according to one embodiment of the present invention includes the electrolytic cell 100 including the positive electrode chamber 130 and the negative electrode chamber 150 which are partitioned by the partition wall 110, the gas-liquid separator 200 at the positive electrode communicating with the positive electrode chamber 130 through the positive electrode recovery pipe 210, the gas-liquid separator 300 at the negative electrode communicating with the negative electrode chamber 150 through the negative electrode recovery pipe 310, and the positive electrode chamber electrolyte reservoir 410 and the negative electrode chamber electrolyte reservoir 420 of the electrolyte correction unit 400 communicating with the gas-liquid separator 200 at the positive electrode and the gas-liquid separator 300 at the negative electrode, respectively, through the positive electrode electrolyte recovery pipe 230 and the negative electrode electrolyte recovery pipe 330. The diaphragm 500 is provided inside the electrolyte correction unit 400, and an electrolyte is supplied to the positive electrode chamber and the negative electrode chamber of the electrolytic cell 100 through the positive electrode electrolyte supply pipe 440 and the negative electrode electrolyte supply pipe 450. In this case, the circulation pumps 600 may be provided at the positive electrode electrolyte supply pipe 440 and the negative electrode electrolyte supply pipe 450.

A KOH aqueous solution may be used as the electrolyte.

In the electrolytic cell 100, an electrolyte with a molar concentration of x is supplied from the electrolyte correction unit 400, and the following reactions occur.

Positive electrode: $2OH^- \rightarrow \frac{1}{2}O_2 + H_2O + 2e^-$

Negative electrode: $2H_2O + 2e^- \rightarrow H_2 + 2OH^-$

That is, hydroxide ions ($OH^-$) are consumed and oxygen gas is generated in the positive electrode chamber, and hydroxide ions ($OH^-$) and hydrogen gas are generated in the negative electrode chamber. Thus, a molar concentration of the electrolyte discharged from the positive electrode chamber is (x−a) mol, and oxygen gas is dissolved in the electrolyte. In addition, a molar concentration of the electrolyte discharged from the negative electrode chamber is (x+a) mol, and hydrogen gas is dissolved in the electrolyte.

The electrolytes discharged from the positive electrode chamber 130 and the negative electrode chamber 150 move to the gas-liquid separator 200 at the positive electrode and the gas-liquid separator 300 at the negative electrode through the positive electrode recovery pipe 210 and the negative electrode recovery pipe 310.

In the gas-liquid separator 200 at the positive electrode, the oxygen gas dissolved in the electrolyte is present in the gas-phase area, the electrolyte is present in the liquid-phase area, and the oxygen gas discharge pipe 220 for discharging the oxygen gas to the outside of the system may be provided in the gas-phase area. In addition, the electrolyte present in the liquid-phase area is introduced into the positive electrode chamber electrolyte reservoir 410 of the electrolyte correction unit 400 through the positive electrode electrolyte recovery pipe 230.

In the gas-liquid separator 300 at the negative electrode, the hydrogen gas dissolved in the electrolyte is present in the gas-phase area and the electrolyte is present in the liquid-phase area, the hydrogen gas discharge pipe 320 for discharging the hydrogen gas to the outside of the system may be provided in the gas-phase area. In addition, the electrolyte present in the liquid-phase area is introduced into the negative electrode chamber electrolyte reservoir 420 of the electrolyte correction unit 400 through the negative electrode electrolyte recovery pipe 330.

In this case, the oxygen gas and the hydrogen gas are partially dissolved in the electrolytes present in the liquid-phase areas.

Referring to FIG. 4, in the electrolyte correction unit 400, (x−a) mol of the electrolyte introduced through the positive electrode electrolyte recovery pipe 230 and (x+a) mol of the electrolyte introduced through the negative electrode electrolyte recovery pipe 330 are supplied to the positive electrode chamber electrolyte reservoir 410 and the negative electrode chamber electrolyte reservoir 420, respectively, by the diaphragm 500.

An ion-permeable diaphragm is used as the diaphragm 500 in order to allow ions to pass through and block the hydrogen gas and the oxygen gas, which are generated in the electrolytic cell, from passing therethrough.

The diaphragm has a plurality of fine through-pores, has a structure capable of permeating the electrolyte, and has gas blockability to prevent the hydrogen gas and the oxygen gas, which are dissolved in the electrolyte, from passing therethrough.

Therefore, since a concentration of (x+a) mol of the electrolyte introduced through the negative electrode electrolyte recovery pipe 330 is greater than that of (x−a) mol the electrolyte introduced through the positive electrode electrolyte recovery pipe 230, ions of the electrolyte introduced through the negative electrode electrolyte recovery pipe move to the electrolyte introduced through the positive electrode electrolyte recovery pipe 230 through the diaphragm, and thus a concentration gradient between the electrolytes in the electrolyte correction unit 400 separated by the diaphragm disappears.

In addition, since mixing of the oxygen gas and the hydrogen gas is prevented by the diaphragm 500 in the electrolyte correction unit 400, the risk of explosion due to the concentration of the hydrogen gas in the oxygen gas exceeding the explosion range can be prevented.

Example 1-2

In Example 1-2, a configuration is the same as in Example 1-1, except that a plurality of porous diaphragms are provided in the electrolytic cell correction unit 400.

N+1 electrolyte reservoirs are formed in the electrolyte correction unit 400 by a plurality of n porous diaphragms, and (x−a) mol of the electrolyte introduced from the gas-liquid separator 200 at the positive electrode and (x+a) mol of the electrolyte introduced from the gas-liquid separator 300 at the negative electrode are alternately introduced into the n+1 electrolyte reservoirs.

In this case, the positive electrode electrolyte supply pipe 440 and the negative electrode electrolyte supply pipe 450 for supplying the electrolyte from the electrolyte correction unit 400 to the electrolytic cell 100 may be formed as one pipe, and a branch (manifold) may be provided in the electrolyte correction unit 400 for smooth supply of the electrolyte to the electrolyte reservoirs. In addition, the positive electrode electrolyte supply pipe 440 and the negative electrode electrolyte supply pipe 450 may be formed as a plurality of positive electrode electrolyte supply pipes and a plurality of negative electrode electrolyte supply pipes corresponding to the n+1 electrolyte reservoirs.

Example 1-3

In Example 1-3, a configuration is the same as in Example 1-1, except that a cation exchange membrane 510 is used in the electrolyte correction unit 400 instead of the porous diaphragm.

The cation exchange membrane 510 selectively transmits only cations in the electrolyte and has gas blockability.

In this case, in the electrolyte correction unit 400, cations (i.e., $K^+$ ions) of (x+a) mol of the electrolyte in the negative electrode chamber electrolyte reservoir 420, which is introduced from the gas-liquid separator 300 at the negative electrode, move to the (x−a) mol of an electrolyte in the positive electrode chamber electrolyte reservoir 410, which is introduced from an adjacent gas-liquid separator 200 at the positive electrode, through the cation exchange membrane, due to a concentration gradient. Then, in order to keep an ion balance, anions may move through the membrane even though the cation exchange membrane has cation selectivity. That is, the anions (i.e., $OH^-$ ions) of the (x+a) mol of the electrolyte in the negative electrode chamber electrolyte reservoir 420 move to (x−a) mol of electrolyte in the adjacent positive electrode chamber electrolyte reservoir 410 through the cation exchange membrane. Consequently, the final concentration of the electrolyte discharged from the electrolyte correction unit 400 becomes x mol.

Example 1-4

In Example 1-4, a configuration is the same as in Example 1-3, except that the cation exchange membrane 510 is provided as a plurality of cation exchange membranes 510 in the electrolytic cell correction unit 400.

Referring to FIG. 5, the cation exchange membranes selectively transmit only cations in the electrolyte and have gas blockability.

N+1 electrolyte reservoirs are formed in the electrolyte correction unit 400 by a plurality of n cation exchange membranes, and (x−a) mol of the electrolyte introduced from the gas-liquid separator 200 at the positive electrode and (x+a) mol of the electrolyte introduced from the gas-liquid separator 300 at the negative electrode are alternately introduced into the n+1 electrolyte reservoirs.

In this case, in the electrolyte correction unit 400, cations (i.e., $K^+$ ions) of (x+a) mol of the electrolyte in the negative electrode chamber electrolyte reservoir 420, which is introduced from the gas-liquid separator 300 at the negative electrode, move to the (x−a) mol of an electrolyte in the positive electrode chamber electrolyte reservoir 410, which is introduced from an adjacent gas-liquid separator 200 at the positive electrode, through the cation exchange membranes due to a concentration gradient. Then, in order to keep an ion balance, anions may move through the membranes even though the cation exchange membranes have cation selectivity. That is, in order to keep the ion balance, the anions (i.e., $OH^-$ ions) of the (x+a) moles of the electrolyte in the negative electrode chamber electrolyte reservoir 420 move to (x−a) moles of electrolyte in the adjacent positive electrode chamber electrolyte reservoir 410 through the ion exchange membranes. Consequently, the final concentration of the electrolyte discharged from the electrolyte correction unit 400 becomes x mol.

In this case, the positive electrode electrolyte supply pipe 440 and the negative electrode electrolyte supply pipe 450 for supplying the electrolyte from the electrolyte correction unit 400 to the electrolytic cell 100 may each be formed as one pipe. Alternatively, the positive electrode electrolyte supply pipe 440 and the negative electrode electrolyte supply pipe 450 may be formed as a plurality of positive electrode electrolyte supply pipes 440 and a plurality of negative electrode electrolyte supply pipes 450 to correspond to the n+1 electrolyte reservoirs.

In addition, the positive electrode electrolyte recovery pipe 230 and the negative electrode electrolyte recovery pipe 330 for supplying the electrolyte from the gas-liquid separator 200 at the positive electrode and the gas-liquid separator 300 at the negative electrode to the electrolyte correction unit 400 may each be one pipe. Alternatively, the positive electrode electrolyte recovery pipe 230 and the negative electrode electrolyte recovery pipe 330 may be formed as a plurality of positive electrode electrolyte recovery pipes 230 and a plurality of negative electrode electrolyte recovery pipes 330 to correspond to the n+1 electrolyte reservoirs.

A branch (manifold) for smooth supply and discharge of the electrolyte may be provided inside the electrolyte correction unit.

In addition, since the cation exchange membrane 510 has gas blockability, the mixing of the oxygen gas and the hydrogen gas can be prevented, and the risk of explosion, in which the concentration of the hydrogen gas in the oxygen gas and the concentration of the oxygen gas in the hydrogen gas are formed to be greater than or equal to the explosion range, can be prevented.

Example 1-5

In Example 1-5, a configuration is the same as in Example 1-1, except that an anion exchange membrane 520 is used in the electrolyte correction unit 400 instead of the porous diaphragm.

The anion exchange membrane 520 selectively transmits only anions in the electrolyte and has gas blockability.

In this case, in the electrolyte correction unit 400, anions (i.e., $OH^-$ ions) of (x+a) mol of the electrolyte introduced from the gas-liquid separator 300 at the negative electrode, move to (x−a) mol of an electrolyte introduced from an adjacent gas-liquid separator 200 at the positive electrode, through the anion exchange membrane 520 due to a concentration gradient. Then, in order to keep an ion balance, cations may move through the membrane even though the cation exchange membrane has cation selectivity. That is, the cations (i.e., $K^+$ ions) of the (x+a) mol of the electrolyte introduced from the gas-liquid separator 300 at the negative electrode move to (x−a) mol of an electrolyte introduced from the gas-liquid separator 200 at the positive electrode through the anion exchange membrane. Consequently, the final concentration of the electrolyte discharged from the electrolyte correction unit 400 becomes x mol.

Example 1-6

In Example 1-6, a configuration is the same as in Example 1-5, except that the anion exchange membrane 520 is provided as a plurality of anion exchange membranes 520 in the electrolytic cell correction unit 400.

Referring to FIG. 6, the anion exchange membranes 520 selectively transmit only anions in the electrolyte and have gas blockability.

N+1 electrolyte inflow spaces are formed in the electrolyte correction unit 400 by a plurality of n anion exchange membranes, and (x−a) mol of an electrolyte introduced from the gas-liquid separator 200 at the positive electrode and (x+a) mol of an electrolyte introduced from the gas-liquid separator 300 at the negative electrode are alternately introduced into the n+1 electrolyte inflow spaces.

In this case, in the electrolyte correction unit 400, anions (i.e., $OH^-$ ions) of the (x+a) mol of the electrolyte introduced from the gas-liquid separator 300 at the negative electrode move to the (x−a) mol of an electrolyte introduced from an adjacent gas-liquid separator 200 at the positive electrode, through the anion exchange membranes due to a concentration gradient. Then, in order to keep an ion balance, cations may move through the membranes even though the anion exchange membranes have anion selectivity. That is, the cations (i.e., $K^+$ ions) of the (x+a) mol of the electrolyte introduced from the gas-liquid separator 300 at the negative electrode move to the (x−a) mol of the electrolyte introduced from the gas-liquid separator 200 at the positive electrode through the ion exchange membranes. Consequently, the final concentration of the electrolyte discharged from the electrolyte correction unit 400 becomes x mol.

In this case, the positive electrode electrolyte supply pipe 440 and the negative electrode electrolyte supply pipe 450 for supplying the electrolyte from the electrolyte correction unit 400 to the electrolytic cell 100 may each be formed as one pipe. Alternatively, the positive electrode electrolyte supply pipe 440 and the negative electrode electrolyte supply pipe 450 may be formed as a plurality of positive electrode electrolyte supply pipes 440 and a plurality of negative electrode electrolyte supply pipes 450 to correspond to the n+1 electrolyte reservoirs.

In addition, the positive electrode electrolyte recovery pipe 230 and the negative electrode electrolyte recovery pipe 330 for supplying the electrolyte from the gas-liquid separator 200 at the positive electrode and the gas-liquid separator 300 at the negative electrode to the electrolyte correction unit 400 may each be one pipe. Alternatively, the positive electrode electrolyte recovery pipe 230 and the negative electrode electrolyte recovery pipe 330 may be formed as a plurality of positive electrode electrolyte recovery pipes 230 and a plurality of negative electrode electrolyte recovery pipes 330 to correspond to the n+1 electrolyte reservoirs.

A branch (manifold) for smooth supply and discharge of the electrolyte may be provided inside the electrolyte correction unit.

In addition, since the anion exchange membranes 520 have gas blockability, the mixing of the oxygen gas and the hydrogen gas can be prevented, and the risk of explosion, in which the concentration of the hydrogen gas in the oxygen gas and the concentration of the oxygen gas in the hydrogen gas are formed to be greater than or equal to the explosion range, can be prevented.

Example 1-7

Referring to FIG. 7, in Example 1-7, a plurality of cation exchange membranes 510 and a plurality of anion exchange membranes 520 are alternately provided in the electrolytic cell correction unit 400. In this case, the cation exchange membrane selectively transmits only cations in the electrolyte, and the anion exchange membrane selectively transmits only anions in the electrolyte.

N+1 electrolyte reservoirs are formed in the electrolyte correction unit 400 by a plurality of n cation exchange membranes 510 and a plurality of anion exchange membranes 520, and (x−a) mol of the electrolyte introduced from the gas-liquid separator 200 at the positive electrode and (x+a) mol of the electrolyte introduced from the gas-liquid separator 300 at the negative electrode are alternately introduced into the n+1 electrolyte reservoirs.

In this case, in the electrolyte correction unit 400, anions (i.e., $OH^-$ ions) of (x+a) mol of the electrolyte in the negative electrode chamber electrolyte reservoir 420, which is introduced from the gas-liquid separator 300 at the negative electrode, move to the (x−a) mol of an electrolyte in the positive electrode chamber electrolyte reservoir 410, which is introduced from an adjacent gas-liquid separator 200 at the positive electrode, through the anion exchange membrane 520 due to a concentration gradient. In addition, the cations (i.e., $K^+$ ions) of the (x+a) mol of the electrolyte in the negative electrode chamber electrolyte reservoir 420 move to (x−a) mol of electrolyte in an adjacent positive electrode chamber electrolyte reservoir 410 through the cation exchange membrane 510. Consequently, the final concentration of the electrolyte discharged from the electrolyte correction unit 400 becomes x mol.

In this case, the positive electrode electrolyte supply pipe 440 and the negative electrode electrolyte supply pipe 450 for supplying the electrolyte from the electrolyte correction unit 400 to the electrolytic cell 100 may each be formed as one pipe. Alternatively, the positive electrode electrolyte supply pipe 440 and the negative electrode electrolyte supply pipe 450 may be formed as a plurality of positive electrode electrolyte supply pipes 440 and a plurality of negative electrode electrolyte supply pipes 450 to correspond to the n+1 electrolyte reservoirs.

In addition, the positive electrode electrolyte recovery pipe 230 and the negative electrode electrolyte recovery pipe 330 for supplying the electrolyte from the gas-liquid separator 200 at the positive electrode and the gas-liquid separator 300 at the negative electrode to the electrolyte correction unit 400 may each be one pipe. Alternatively, the positive electrode electrolyte recovery pipe 230 and the negative electrode electrolyte recovery pipe 330 may be formed as a plurality of positive electrode electrolyte recovery pipes 230 and a plurality of negative electrode electrolyte recovery pipes 330 to correspond to the n+1 electrolyte reservoirs.

A branch (manifold) for smooth supply and discharge of the electrolyte may be provided inside the electrolyte correction unit.

In addition, since the cation exchange membrane 510 has gas blockability, the mixing of the oxygen gas and the hydrogen gas can be prevented, and the risk of explosion, in which the concentration of the hydrogen gas in the oxygen gas and the concentration of the oxygen gas in the hydrogen gas are formed to be greater than or equal to the explosion range, can be prevented.

Example 1-8

Referring to FIG. 8, in Example 1-8, a configuration is the same as in Example 1-7, except that electrodes are provided at both ends of the electrolytic cell correction unit 400.

A positive electrode 460 and a negative electrode 470 are provided at both ends of the electrolytic cell correction unit 400. When power is applied to the positive electrode 460 and the negative electrode 470 to generate a potential difference, ions of an electrolyte in the electrolytic cell correction unit 400 move through the cation exchange membrane 510 and the anion exchange membrane 520.

In this case, the cation exchange membrane 510 is positioned at a side surface adjacent to the positive electrode of the positive electrode chamber electrolyte reservoir 410, the anion exchange membrane 520 is positioned at a side surface adjacent to the negative electrode of the positive electrode chamber electrolyte reservoir 410, the anion exchange membrane 520 is positioned at a side surface adjacent to the positive electrode of the negative electrode chamber electrolyte reservoir 420, and the cation exchange membrane 510 is positioned at a side surface adjacent to the negative electrode of the negative electrode chamber electrolyte reservoir 420.

In this way, when a difference in electromotive force is used through the electrodes, since the movement of ions is accelerated, a concentration correction time of an electrolyte can be reduced.

Example 2-1

Referring to FIG. 3, the water electrolysis device according to one embodiment of the present invention includes the electrolytic cell 100 including the positive electrode chamber 130 and the negative electrode chamber 150 which are partitioned by the partition wall 110, the positive electrode chamber electrolyte reservoir 410 of the electrolyte correction unit 400 communicating with the positive electrode chamber 130 through the second positive electrode recovery pipe 211, the negative electrode chamber electrolyte reservoir 420 of the electrolyte correction unit 400 communicating with the negative electrode chamber 150 through the second negative electrode recovery pipe 311, wherein, in the electrolyte correction unit 400, the positive electrode chamber electrolyte reservoir 410 and the negative electrode chamber electrolyte reservoir 420 are divided by the diaphragm 500, and the gas-liquid separator 200 at the positive electrode and the gas-liquid separator 300 at the negative electrode communicating with the positive electrode chamber electrolyte reservoir 410 and the negative electrode chamber electrolyte reservoir 420, respectively, through the second positive electrode electrolyte recovery pipe 231 and the second negative electrode electrolyte recovery pipe 331. The gas-liquid separator 200 at the positive electrode and the gas-liquid separator 300 at the negative electrode supply electrolytes to the positive electrode chamber and the negative electrode chamber of the electrolytic cell 100 through the second positive electrode electrolyte supply pipe 441 and the second negative electrode electrolyte supply pipe 451. In this case, the circulation pumps 600 may be provided at the second positive electrode electrolyte supply pipe 441 and the second negative electrode electrolyte supply pipe 451.

A KOH aqueous solution may be used as the electrolyte.

In the electrolytic cell 100, an electrolyte with a molar concentration of x is supplied from the electrolyte correction unit 400, and the following reactions occur.

Positive electrode: $2OH^- \rightarrow \frac{1}{2}O_2 + H_2O + 2e^-$

Negative electrode: $2H_2O + 2e^- \rightarrow H_2 + 2OH^-$

That is, hydroxide ions ($OH^-$) are consumed and oxygen gas is generated in the positive electrode chamber, and hydroxide ions ($OH^-$) and hydrogen gas are generated in the negative electrode chamber. Thus, a molar concentration of the electrolyte discharged from the positive electrode chamber is (x−a) mol, and oxygen gas is dissolved in the electrolyte. In addition, a molar concentration of the electrolyte discharged from the negative electrode chamber is (x+a) mol, and hydrogen gas is dissolved in the electrolyte.

The electrolytes discharged from the positive electrode chamber 130 and the negative electrode chamber 150 move to the positive electrode chamber electrolyte reservoir 410 and the negative electrode chamber electrolyte reservoir 420 of the electrolyte correction unit 400 through the second positive electrode recovery pipe 211 and the second negative electrode recovery pipe 311.

Oxygen gas and hydrogen gas are dissolved in the electrolytes introduced into the electrolyte correction unit 400 through the second positive electrode recovery pipe 211 and the second negative electrode recovery pipe 311. In the water electrolysis device according to the present embodiment, since the oxygen gas, the hydrogen gas, and the electrolytes, which are discharged from the electrolytic cell, have not yet passed through the gas-liquid separator 200 at the positive electrode and the gas-liquid separator 300 at the negative electrode, relatively high concentrations of the oxygen gas and the hydrogen gas are dissolved compared to the first embodiment.

Referring to FIG. 4, in the electrolyte correction unit 400, (x−a) mol of the electrolyte introduced through the second positive electrode recovery pipe 211 and (x+a) mol of the electrolyte introduced through the second negative electrode recovery pipe 311 are supplied to the positive electrode chamber electrolyte reservoir 410 and the negative electrode chamber electrolyte reservoir 420, respectively, by the diaphragm 500.

An ion-permeable diaphragm is used as the diaphragm 500 in order to allow ions to pass through and isolate the hydrogen gas and the oxygen gas, which are generated in the electrolytic cell, from passing therethrough.

The diaphragm has a plurality of fine through-pores, has a structure capable of permeating the electrolyte, and has gas blockability to prevent the hydrogen gas and the oxygen gas, which are dissolved in the electrolyte, from passing therethrough.

Therefore, since the (x+a) mol of the electrolyte of the negative electrode chamber electrolyte reservoir 420 introduced through the second negative electrode recovery pipe 311 has a concentration that is higher than that of the (x−a) mol of the electrolyte of the positive electrode chamber electrolyte reservoir 410 introduced through the second positive electrode recovery pipe 211, ions of the electrolyte in the negative electrode chamber electrolyte reservoir 420 move to the electrolyte in the positive electrode chamber electrolyte reservoir 410 through the diaphragm. Thus, a concentration gradient of the electrolytes in the electrolyte correction unit separated by the diaphragm disappears.

In addition, since mixing of the oxygen gas and the hydrogen gas is prevented by the diaphragm 500 in the electrolyte correction unit 400, the risk of explosion due to the concentration of the hydrogen gas in the oxygen gas exceeding the explosion range can be prevented.

In the gas-liquid separator 200 at the positive electrode, the oxygen gas dissolved in the electrolyte is present in the gas-phase area and the electrolyte is present in the liquid-phase area, and the oxygen gas discharge pipe 220 for discharging the oxygen gas to the outside of the system may be provided in the gas-phase area. In addition, the electrolyte present in the liquid-phase area is introduced into the positive electrode chamber 130 of the electrolytic cell 100 through the second positive electrode electrolyte supply pipe 441.

In the gas-liquid separator 300 at the negative electrode, the hydrogen gas dissolved in the electrolyte is present in the gas-phase area, the electrolyte is present in the liquid-phase area, and the hydrogen gas discharge pipe 320 for discharging the hydrogen gas to the outside of the system may be provided in the gas-phase area. In addition, the electrolyte present in the liquid-phase area is introduced into the negative electrode chamber 150 of the electrolytic cell 100 through the second negative electrode electrolyte supply pipe 451.

Example 2-2

In Example 2-2, a configuration is the same as in Example 2-1, except that a plurality of porous diaphragms are provided in the electrolytic cell correction unit 400.

N+1 electrolyte reservoirs are formed in the electrolyte correction unit 400 by a plurality of n porous diaphragms, and (x−a) mol of an electrolyte introduced from the positive electrode chamber 130 and (x+a) mol of an electrolyte introduced from the negative electrode chamber 150 are alternately introduced into the n+1 electrolyte reservoirs.

In this case, in the electrolyte correction unit 400, the second positive electrode electrolyte recovery pipe 231 and the second negative electrode electrolyte recovery pipe 331 for supplying the electrolytes to the gas-liquid separator 200 at the positive electrode and the gas-liquid separator 300 at the negative electrode may each be formed as one pipe and may each have a branch (manifold) for smooth supply to the electrolyte reservoirs. Alternatively, the second positive electrode electrolyte recovery pipe 231 and the second negative electrode electrolyte recovery pipe 331 may be formed as a plurality of second positive electrode electrolyte recovery pipes 231 and a plurality of second negative electrode electrolyte recovery pipes 331 to correspond to the n+1 electrolyte reservoirs.

Example 2-3

In Example 2-3, a configuration is the same as in Example 2-1, except that a cation exchange membrane 510 is used in the electrolyte correction unit 400 instead of the porous diaphragm.

The cation exchange membrane 510 selectively transmits only cations in the electrolyte and has gas blockability.

In this case, in the electrolyte correction unit 400, cations (i.e., $K^+$ ions) of (x+a) mol of the electrolyte in the negative electrode chamber electrolyte reservoir 420, which is introduced from the negative electrode chamber 150, move to (x−a) mol of an electrolyte in the positive electrode chamber electrolyte reservoir 410, which is introduced from an adjacent positive electrode chamber 130, through the cation exchange membrane due to a concentration gradient. Then, in order to keep an ion balance, anions may move through the membrane even though the cation exchange membrane has cation selectivity. That is, the anions (i.e., $OH^-$ ions) of the (x+a) mol of the electrolyte in the negative electrode chamber electrolyte reservoir 420 move to (x−a) mol of electrolyte in the adjacent positive electrode chamber electrolyte reservoir 410 through the cation exchange membrane. Consequently, the final concentration of the electrolyte discharged from the electrolyte correction unit 400 becomes x mol.

Example 2-4

In Example 2-4, a configuration is the same as in Example 2-3, except that the cation exchange membrane 510 is provided as a plurality of cation exchange membranes 510 in the electrolytic cell correction unit 400.

Referring to FIG. 5, the cation exchange membranes selectively transmit only cations in the electrolyte and have gas blockability.

N+1 electrolyte reservoirs are formed in the electrolyte correction unit 400 by a plurality of n cation exchange membranes, and (x−a) mol of an electrolyte introduced from the positive electrode chamber 130 and (x+a) mol of an electrolyte introduced from the negative electrode chamber 150 are alternately introduced into the n+1 electrolyte reservoirs.

In this case, in the electrolyte correction unit 400, cations (i.e., $K^+$ ions) of (x+a) mol of the electrolyte in the negative electrode chamber electrolyte reservoir 420, which is introduced from the negative electrode chamber 150, move to (x−a) mol of an electrolyte in the positive electrode chamber electrolyte reservoir 410, which is introduced from an adjacent positive electrode chamber 130, through the cation exchange membrane due to a concentration gradient. Then, in order to keep an ion balance, anions may move through the membranes even though the cation exchange membranes have cation selectivity. That is, the anions (i.e., $OH^-$ ions) of the (x+a) mol of the electrolyte in the negative electrode chamber electrolyte reservoir 420 moves to (x−a) mol of electrolyte in the adjacent positive electrode chamber electrolyte reservoir 410 through the ion exchange membranes. Consequently, the final concentration of the electrolyte discharged from the electrolyte correction unit 400 becomes x mol.

In this case, in the electrolyte correction unit 400, the second positive electrode electrolyte recovery pipe 231 and the second negative electrode electrolyte recovery pipe 331 for supplying the electrolytes to the gas-liquid separator 200 at the positive electrode and the gas-liquid separator 300 at the negative electrode may each be formed as one pipe. Alternatively, the second positive electrode electrolyte recovery pipe 231 and the second negative electrode electrolyte recovery pipe 331 may be formed as a plurality of second positive electrode electrolyte recovery pipes 231 and a plurality of second negative electrode electrolyte recovery pipes 331 to correspond to the n+1 electrolyte reservoirs.

Alternatively, in order to supply an electrolyte from the electrolytic cell 100 to the electrolyte correction unit 400, the second positive electrode recovery pipe 211 and the second negative electrode recovery pipe 311 for supplying the electrolytes to the gas-liquid separator 200 at the positive electrode and the gas-liquid separator 300 at the negative electrode may each be formed as one pipe. Alternatively, the second positive electrode recovery pipe 211 and the second negative electrode recovery pipe 311 may be formed as a plurality of second positive electrode recovery pipes 211 and a plurality of second negative electrode recovery pipes 311 to correspond to the n+1 electrolyte reservoirs.

A branch (manifold) for smooth supply and discharge of the electrolyte may be provided inside the electrolyte correction unit.

In addition, since the cation exchange membranes 510 have gas blockability, the mixing of the oxygen gas and the hydrogen gas can be prevented, and the risk of explosion, in which the concentration of the hydrogen gas in the oxygen gas and the concentration of the oxygen gas in the hydrogen gas are formed to be greater than or equal to the explosion range, can be prevented.

Example 2-5

In Example 2-5, a configuration is the same as in Example 2-1, except that an anion exchange membrane 520 is used in the electrolyte correction unit 400 instead of the porous diaphragm.

The anion exchange membrane 520 selectively transmits only anions in the electrolyte and has gas blockability.

In this case, in the electrolyte correction unit 400, anions (i.e., $OH^-$ ions) of (x+a) mol of the electrolyte in the negative electrode chamber electrolyte reservoir 420, which is introduced from the negative electrode chamber 150, move to (x−a) mol of an electrolyte in the positive electrode chamber electrolyte reservoir 410, which is introduced from an adjacent positive electrode chamber 130, through the anion exchange membrane due to a concentration gradient. Then, in order to keep an ion balance, cations may move through the membrane even though the cation exchange membrane has cation selectivity. That is, the cations (i.e., $K^+$ ions) of (x+a) mol of the electrolyte in the negative electrode chamber electrolyte reservoir 420, which is introduced from the negative electrode chamber 150, move to (x−a) mol of an electrolyte in the positive electrode chamber electrolyte reservoir 410, which is introduced from an adjacent positive electrode chamber 130, through the anion exchange membrane. Consequently, the final concentration of the electrolyte discharged from the electrolyte correction unit 400 becomes x mol.

Example 2-6

In Example 2-6, a configuration is the same as in Example 2-5, except that the anion exchange membrane 520 is provided as a plurality of anion exchange membranes in the electrolytic cell correction unit 400.

Referring to FIG. 6, the anion exchange membranes 520 selectively transmit only anions in the electrolyte and have gas blockability.

N+1 electrolyte reservoirs are formed in the electrolyte correction unit 400 by a plurality of n anion exchange membranes, and (x−a) mol of an electrolyte introduced from the positive electrode chamber 130 and (x+a) mol of an electrolyte introduced from the negative electrode chamber 150 are alternately introduced into the n+1 electrolyte reservoirs.

In this case, in the electrolyte correction unit 400, anions (i.e., $OH^-$ ions) of (x+a) mol of the electrolyte in the negative electrode chamber electrolyte reservoir 420, which is introduced from the negative electrode chamber 150, moves to (x−a) mol of an electrolyte in the positive electrode chamber electrolyte reservoir 410, which is introduced from an adjacent positive electrode chamber 130, through the anion exchange membranes due to a concentration gradient. Then, in order to keep an ion balance, cations may move through the membranes even though the anion exchange membranes have anion selectivity. That is, the cations (i.e., $K^+$ ions) of (x+a) mol of the electrolyte in the negative electrode chamber electrolyte reservoir 420, which is introduced from the negative electrode chamber 150, move to (x−a) mol of an electrolyte in the positive electrode chamber electrolyte reservoir 410, which is introduced from an adjacent positive electrode chamber 130, through the ion exchange membrane. Consequently, the final concentration of the electrolyte discharged from the electrolyte correction unit 400 becomes x mol.

In this case, in the electrolyte correction unit 400, the second positive electrode electrolyte recovery pipe 231 and the second negative electrode electrolyte recovery pipe 331 for supplying the electrolytes to the gas-liquid separator 200 at the positive electrode and the gas-liquid separator 300 at the negative electrode may each be formed as one pipe. Alternatively, the second positive electrode electrolyte recovery pipe 231 and the second negative electrode electrolyte recovery pipe 331 may be formed as a plurality of second positive electrode electrolyte recovery pipes 231 and a plurality of second negative electrode electrolyte recovery pipes 331 to correspond to the n+1 electrolyte reservoirs.

Alternatively, in order to supply an electrolyte from the electrolytic cell 100 to the electrolyte correction unit 400, the second positive electrode recovery pipe 211 and the second negative electrode recovery pipe 311 for supplying the electrolytes to the gas-liquid separator 200 at the positive electrode and the gas-liquid separator 300 at the negative electrode may each be formed as one pipe. Alternatively, the second positive electrode recovery pipe 211 and the second negative electrode recovery pipe 311 may be formed as a plurality of second positive electrode recovery pipes 211 and a plurality of second negative electrode recovery pipes 311 to correspond to the n+1 electrolyte reservoirs.

A branch (manifold) for smooth supply and discharge of the electrolyte may be provided inside the electrolyte correction unit.

In addition, since the anion exchange membranes 520 have gas blockability, the mixing of the oxygen gas and the hydrogen gas can be prevented, and the risk of explosion, in which the concentration of the hydrogen gas in the oxygen gas and the concentration of the oxygen gas in the hydrogen gas are formed to be greater than or equal to the explosion range, can be prevented.

Example 2-7

Referring to FIG. 7, in Example 2-7, a plurality of cation exchange membranes 510 and a plurality of anion exchange membranes 520 are alternately provided in the electrolytic cell correction unit 400. In this case, the cation exchange membranes selectively transmit only cations in the electrolyte, and the anion exchange membranes selectively transmit only anions in the electrolyte.

N+1 electrolyte reservoirs are formed in the electrolyte correction unit 400 by a plurality of n cation exchange membranes 510 and a plurality of n anion exchange membranes 520, and (x−a) mol of the electrolyte introduced from the positive electrode chamber 130 and (x+a) mol of the electrolyte introduced from the negative electrode chamber 150 are alternately introduced into the n+1 electrolyte reservoirs.

In this case, in the electrolyte correction unit 400, anions (i.e., $OH^-$ ions) of (x+a) mol of the electrolyte in the negative electrode chamber electrolyte reservoir 420, which is introduced from the negative electrode chamber 150, move to (x−a) mol of an electrolyte in the positive electrode chamber electrolyte reservoir 410, which is introduced from an adjacent positive electrode chamber 130, through the anion exchange membranes 520 due to a concentration gradient. In addition, the cations (i.e., $K^+$ ions) of (x+a) mol of the electrolyte in the negative electrode chamber electrolyte reservoir 420, which is introduced from the negative electrode chamber 150, move to (x−a) mol of an electrolyte in the positive electrode chamber electrolyte reservoir 410, which is introduced from an adjacent positive electrode chamber 130, through the cation exchange membranes 510. Consequently, the final concentration of the electrolyte discharged from the electrolyte correction unit 400 becomes x mol.

In this case, in the electrolyte correction unit 400, the second positive electrode electrolyte recovery pipe 231 and the second negative electrode electrolyte recovery pipe 331 for supplying the electrolytes to the gas-liquid separator 200 at the positive electrode and the gas-liquid separator 300 at the negative electrode may each be formed as one pipe. Alternatively, the second positive electrode electrolyte recovery pipe 231 and the second negative electrode electrolyte recovery pipe 331 may be formed as a plurality of second positive electrode electrolyte recovery pipes 231 and a plurality of second negative electrode electrolyte recovery pipes 331 to correspond to the n+1 electrolyte reservoirs.

Alternatively, in order to supply an electrolyte from the electrolytic cell 100 to the electrolyte correction unit 400, the second positive electrode recovery pipe 211 and the second negative electrode recovery pipe 311 for supplying the electrolytes to the gas-liquid separator 200 at the positive electrode and the gas-liquid separator 300 at the negative electrode may each be formed as one pipe. Alternatively, the second positive electrode recovery pipe 211 and the second negative electrode recovery pipe 311 may be formed as a plurality of second positive electrode recovery pipes 211 and a plurality of second negative electrode recovery pipes 311 to correspond to the n+1 electrolyte reservoirs.

A branch (manifold) for smooth supply and discharge of the electrolyte may be provided inside the electrolyte correction unit.

In addition, since the anion exchange membranes 520 have gas blockability, the mixing of the oxygen gas and the hydrogen gas can be prevented, and the risk of explosion, in which the concentration of the hydrogen gas in the oxygen gas and the concentration of the oxygen gas in the hydrogen gas are formed to be greater than or equal to the explosion range, can be prevented.

Example 2-8

Referring to FIG. 8, in Example 2-8, a configuration is the same as in Example 2-7, except that electrodes are provided at both ends of the electrolytic cell correction unit 400.

A positive electrode 460 and a negative electrode 470 are provided at both ends of the electrolytic cell correction unit 400. When power is applied to the positive electrode 460 and the negative electrode 470 to generate a potential difference, ions of an electrolyte in the electrolytic cell correction unit 400 move through the cation exchange membrane 510 and the anion exchange membrane 520.

In this case, the cation exchange membrane 510 is positioned at a side surface adjacent to the positive electrode 460 of the positive electrode chamber electrolyte reservoir, the anion exchange membrane 520 is positioned at a side surface adjacent to the negative electrode 470 of the positive electrode chamber electrolyte reservoir, the anion exchange membrane 520 is positioned at a side surface adjacent to the positive electrode of the negative electrode chamber electrolyte reservoir, and the cation exchange membrane 510 is positioned at a side surface adjacent to the negative electrode of the negative electrode chamber electrolyte reservoir.

In this way, when a difference in electromotive force is used through the electrodes, since the movement of ions is accelerated, a concentration correction time of an electrolyte can be reduced.

INDUSTRIAL APPLICABILITY

In accordance with a water electrolysis device according to the present invention, by including an electrolyte correction unit with a diaphragm for eliminating a difference in concentration between electrolytes, a gas composition in a gas-phase area of an electrolyte reservoir is prevented from reaching an explosion limit, and simultaneously, a concentration difference between electrolytes is prevented even when an electrolyte discharged from a positive electrode chamber and an electrolyte discharged from a negative electrode chamber are independently circulated. Thus, there is an effect of not requiring an additional device for solving the problem of reaching the explosion limit and the concentration difference and preventing deterioration in processability due to electrolyte re-injection and operation stabilization.

The invention claimed is:

1. A water electrolysis device comprising:

an electrolytic cell including a positive electrode chamber and a negative electrode chamber, which are partitioned by a partition wall;

an electrolyte correction unit including a positive electrode chamber electrolyte reservoir and a negative electrode chamber electrolyte reservoir, wherein the positive electrode chamber electrolyte reservoir and the negative electrode chamber electrolyte reservoir are divided from each other by a diaphragm;

a positive electrode circulation line configured to communicate the positive electrode chamber of the electrolytic cell with the positive electrode chamber electrolyte reservoir of the electrolyte correction unit;

a negative electrode circulation line configured to communicate the negative electrode chamber of the electrolytic cell with the negative electrode chamber electrolyte reservoir of the electrolyte correction unit;

a gas-liquid separator at a positive electrode provided at the positive electrode circulation line; and a gas-liquid separator at a negative electrode provided at the negative electrode circulation line, wherein the gas-liquid separator at the positive electrode is provided between the positive electrode chamber of the electrolytic cell and the positive electrode chamber electrolyte reservoir of the electrolyte correction unit along the positive electrode circulation line, wherein the gas-liquid separator at the negative electrode is provided between the negative electrode chamber of the electrolytic cell and the negative electrode chamber electrolyte reservoir of the electrolyte correction unit along the negative electrode circulation line, and wherein the electrolyte correction unit is provided to correct the difference in concentration between the electrolyte discharged from the positive electrode chamber and the electrolyte discharged from the negative electrode chamber.

2. The water electrolysis device of claim 1, wherein:

the gas-liquid separator at the positive electrode is provided between a rear end of the positive electrode chamber of the electrolytic cell and a front end of the positive electrode chamber electrolyte reservoir of the electrolyte correction unit along the positive electrode circulation line; and the gas-liquid separator at the negative electrode is provided between a rear end of the negative electrode chamber of the electrolytic cell and a front end of the negative electrode chamber electrolyte reservoir of the electrolyte correction unit along the negative electrode circulation line.

3. The water electrolysis device of claim 1, wherein:

the gas-liquid separator at the positive electrode is provided between a rear end of the positive electrode chamber electrolyte reservoir of the electrolyte correction unit and a front end of the positive electrode chamber of the electrolytic cell along the positive electrode circulation line; and the gas-liquid separator at the negative electrode is provided between a rear end of the negative electrode chamber electrolyte reservoir of the electrolyte correction unit and a front end of the negative electrode chamber of the electrolytic cell along the negative electrode circulation line.

4. The water electrolysis device of claim 1, wherein the diaphragm is permeable to an electrolyte and an ion and is impermeable to a gas.

5. The water electrolysis device of claim 1, wherein the diaphragm is a porous membrane.

6. The water electrolysis device of claim 1, wherein the diaphragm includes a cation exchange membrane or an anion exchange membrane.

7. The water electrolysis device of claim 1, wherein:

the diaphragm is provided as a plurality of diaphragms; and the positive electrode chamber electrolyte reservoir and the negative electrode chamber electrolyte reservoir are alternately disposed.

8. The water electrolysis device of claim 7, wherein, when the positive electrode chamber electrolyte reservoir and the negative electrode chamber electrolyte reservoir are alternately disposed, the plurality of diaphragms alternately disposed in a direction in which the reservoirs are alternately disposed include cation exchange membranes and anion exchange membranes, which are alternately provided.

9. The water electrolysis device of claim 7, wherein a positive electrode and a negative electrode are provided at both ends of the electrolyte correction unit, and thus the diaphragm is positioned between the positive electrode and the negative electrode.

10. The water electrolysis device of claim 9, wherein:

the diaphragm includes a cation exchange membrane or an anion exchange membrane;

the cation exchange membrane is positioned at a side surface adjacent to the positive electrode of the positive electrode chamber electrolyte reservoir, and the anion exchange membrane is positioned at a side surface adjacent to the negative electrode of the positive electrode chamber electrolyte reservoir; and the anion exchange membrane is positioned at a side surface adjacent to the positive electrode of the negative electrode chamber electrolyte reservoir, and the cation exchange membrane is positioned at a side surface adjacent to the negative electrode of the negative electrode chamber electrolyte reservoir.

11. The water electrolysis device of claim 1, wherein a water supply pipe and a water supply pump, which are configured to supply water, are further provided in at least one among the negative electrode chamber of the electrolytic cell, the negative electrode circulation line and the negative electrode chamber electrolyte reservoir of the electrolyte correction unit.

12. The water electrolysis device of claim 1, wherein a water supply pipe and a water supply pump, which are configured to supply water, are further provided in at least one among the negative electrode chamber of the electrolytic cell, the negative electrode chamber electrolyte reservoir of the electrolyte correction unit, the gas-liquid separator at the negative electrode, and the negative electrode circulation line.

* * * * *